United States Patent [19]

Kobayashi et al.

[11] Patent Number: 4,765,280

[45] Date of Patent: Aug. 23, 1988

[54] DIRECT-CONTACT TYPE HOT WATER HEATER

[75] Inventors: Kunihiro Kobayashi; Saburo Usui, both of Nagano; Shoji Otsuka, Toyono; Choji Najima; Toshimichi Ohara, both of Osaka, all of Japan

[73] Assignees: Maeda Iron Works Co., Ltd.; Osaka Gas Co., Ltd., both of Osaka, Japan

[21] Appl. No.: 8,350

[22] Filed: Jan. 29, 1987

[30] Foreign Application Priority Data

Jan. 31, 1986 [JP] Japan ..... 61-17760
Jan. 26, 1987 [JP] Japan ..... 62-14281

[51] Int. Cl.[4] ..... F22B 37/00

[52] U.S. Cl. ..... 122/5.5 A; 122/31 R; 122/367 PF; 126/355; 126/359; 261/17; 261/94; 261/113

[58] Field of Search ..... 110/215, 233, 234; 122/7 R, 5.5 R, 5.5 A, 10, 367 R, 367 PF, 23, 28, 31 R; 126/355, 359; 261/113, 112, 94, 96, 97, 17, DIG. 9

[56] References Cited

U.S. PATENT DOCUMENTS 1,810,410 6/1931 Alldredge ..... 261/113
3,122,594 2/1964 Kielback ..... 261/94
3,486,307 12/1969 McDermott ..... 261/113
3,525,309 8/1970 Katz ..... 110/215
3,648,682 3/1972 Bougord ..... 126/359
3,826,240 7/1974 Miyahara ..... 126/359 X
4,275,708 6/1981 Wood ..... 126/359 X

FOREIGN PATENT DOCUMENTS 2267812 11/1975 France ..... 261/113
37-17440 10/1962 Japan .
38-15983 8/1963 Japan .
43-31828 12/1968 Japan .
43-31833 12/1968 Japan .

OTHER PUBLICATIONS

"Corcoran Film Trays", Matt. Corcoran Co., Louisville, KY, pp. 1-6, 1970.

*Primary Examiner*—Steven E. Warner
*Attorney, Agent, or Firm*—Oblon, Fisher, Spivak, McClelland & Maier

[57] ABSTRACT

A direct-contact type hot water heater includes a perforated plate having a slope allowing water to flow down from its top apex toward its lower surroundings along both or all sides of the slope in the form of a water film. The perforated plate is provided with a number of apertures capable of forming the water film by surface tension. An endothermic material is arranged in a state where it does not project from the lower surface of the perforated plate.

6 Claims, 2 Drawing Sheets

DIRECT-CONTACT TYPE HOT WATER HEATER

BACKGROUND OF THE INVENTION

1. Field of the Invention

The present invention relates to a direct-contact type hot water heater in which the water, scattered and coming down from above, is designed to flow down along the surrounding side walls of a high-temperature gas feed chamber in the form of a water film without coming down into the feed chamber, whereby, even when fuel is burned in the feed chamber, the efficiency of combustion is improved and the side walls of the feed chamber are prevented from burning off.

2. Statement of the Prior Art

Hithereto, there has been known from Japanese Utility Model Publication Nos. 38-15983, 43-31828 and 43-31833 as well as Japanese Patent Publication No. 37-17440, the technology relating to the direct-contact type hot water heaters of the structure wherein a high-temperature gas feed chamber is provided above a hot water reservoir located on the lowermost portion and an endothermic chamber filled therein with an endothermic material is provided above the high-temperature gas feed chamber so as to bring the water, which is scattered on the endothermic material from above the endothermic chamber and is coming down, into direct contact with a combustion gas resulting from the combustion of fuel in the high-temperature gas feed chamber and thereby obtain hot water of a desired temperature in the lowermost hot water reservoir.

Such direct-contact type hot water heaters excel extremely in thermal efficiency owing to their structure that the water to be heated comes into direct contact with the combustion gas in the course of flowing from the endothermic chamber located above the high-temperature gas feed chamber down into the lowermost hot water reservoir. Moreover, such direct-contact type hot water heaters-can easily be used even at home owing to the system in which water is heated at atmospheric pressure, unlike the conventional boiler system for obtaining hot water in a closed vessel. Additionally, they provide hot water which is free from dissolved oxygen and is thus effective in view of rustproofness. Morever, carbon dioxide contained in the combustion gas is entrapped in the hot water, which means that, when the hot water is used for bathing, it produces an excellent effect such as refreshment which is not attained with hot water obtained by heating usual service water by means of a bath heater. Thus, direct-contact type hot water heater according to the present invention is expected to find a wide use.

However, the conventional direct-contact type hot water heaters are disadvantageous in that their structure is complicated, their installation cost is high, or the combustion gas generated by the combustion of fuel in the combustion chamber does not smoothly flow upwardly. This latter disadvantage can be due to the fact that a perforated plate for supporting the endothermic material filled above the high-temperature gas feed chamber is formed of a horizontally arranged flat plate, a network member depends from the lower end of an umbrella-like member having no vent, as disclosed in Japanese Utility Model Publication No. 38-15983,or umbrella-like members called the flame-dispersing members are supported at intervals in a multi-staged manner or an umbrella-like member is louvered into a complicated shape so as to prevent water from coming down thereon, as disclosed in Japanese Patent Publication No. 37-17440.

SUMMARY OF THE INVENTION

As a result of intensive and extensive studies made to overcome the problems of the perforated plate for supporting an endothermic material filled above the high-temperature gas feed chamber of the conventional direct-contact type hot water heater, it has been found that such problems are eliminated, if provision is made of a perforated plate which includes a slope allowing water to flow down from its top apex toward its lower surroundings along both or all sides thereof in the form of a water film and is provided therein with a number of apertures capable of forming the water film by surface tension, and an endothermic material is arranged in a state where it does not project from the lower surface of the perforated plate.

More specifically, the present invention provides a direct-contact type hot water heater including the lowermost hot water reservoir, a high-temperature gas feed chamber located thereabove, and an endothermic chamber filled therein with an endothermic material and located above the feed chamber, whereby the water, scattered on the endothermic material and coming down, is brought into direct contact with a high-temperature gas supplied to the feed chamber to obtain hot water of a desired temperture in the reservoir. A perforated plate located above the hot water reservoir includes a slope allowing water to flow down from its top apex toward its lower surroundings along both or all sides of the slope in the form of a water film. The perforated plate has a number of apertures capable of forming the water film by surface tension. The endothermic material is arranged in a state where it does not project from the lower surface of the perforated plate.

BRIEF DESCRIPTION OF THE DRAWINGS

The above and other objects and features of the present invention will become apparent from the following detailed description with reference to the accompanying drawings which are given for the purpose of illustration alone and in which.

DETAILED EXPLANATION OF PREFERRED EMBODIMENTS

Figure 1:
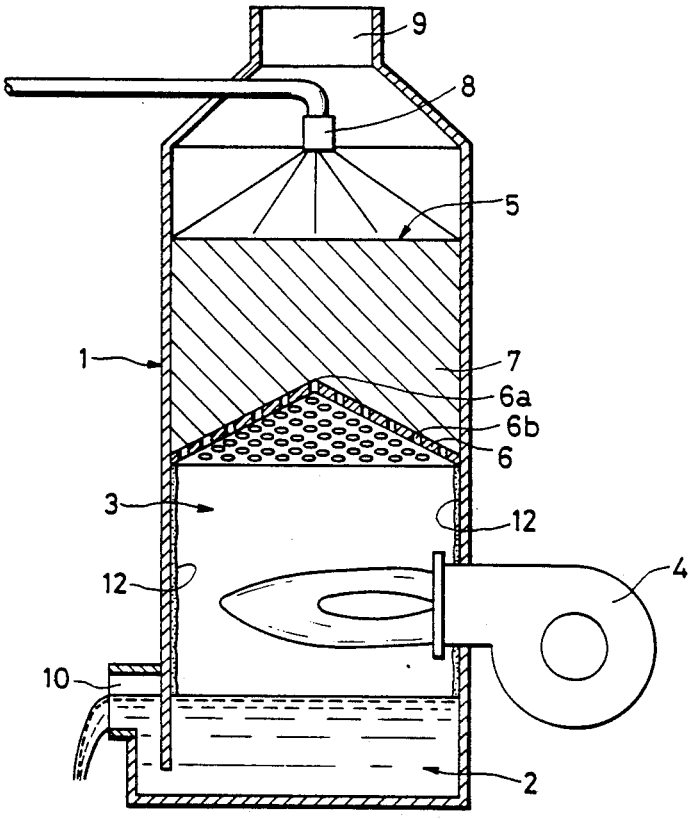
FIG. 1 is a sectional view illustrating one embodiment of the direct-contact type hot water heater according to the present invention.
Figure 2:
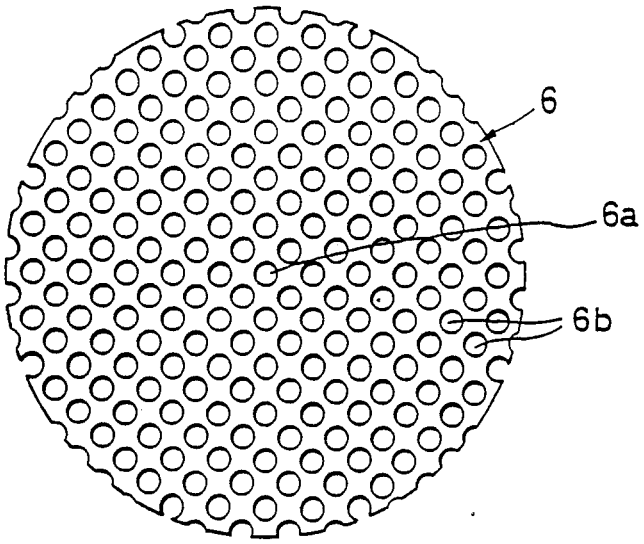
FIG. 2 is a plan view illustrating one embodiment of the perforated plate used with the direct-contact type hot water heater according to the present invention.

Referring to the drawings, a heater body generally shown at 1 is provided with a hot water reservoir 2 at its lowermost portion. Above the reservoir 2 there is provided a high-temperature gas feed chamber 3. In the chamber 3 fuel is burned. The fuel is supplied through a burner 4 such as an oil or gas burner mounted on the side of the heater body 1 as shown in FIG. 1, or a gas or oil burner (not illustrated) mounted within the high-temperature gas feed chamber 3, or a burner (not illustrated) mounted below a combustion flame injection port passing through the reservoir 2. Alternatively, the chamber 3 may be supplied with a combustion gas from a separate device designed to obtain power by burning fuel such as an engine or turbine (hereinafter referred to as the engine, etc.), the device being spaced away from the heater body 1. As will be described later, the high-temperature gas is then allowed to come into direct contact with water, and is discharged, after heating the water, from the upper portion of the heater body 1.

An endotheronic chamber 5 is located above the high-temperature gas feed chamber 3, and it is partitioned from the high-temperature gas feed chamber 3 by a perforated plate 6 having a top apex 6a. The perforated plate can be formed, e.g., of a heat-resistant, metallic plate, on which an endothermic material 7 is filled. The perforated plate 6 is of a shape including a slope allowing water to flow down along its both or all sides from the top apex 6a toward the lower surroundings in the form of a water film (e.g., a conical or pyramidal shape of an angle of inclination, practically, of 10° or wider. The plate 6 is provided therein with a number of apertures 6b capable of forming a water film 11 by surface tension.

Figure 3:
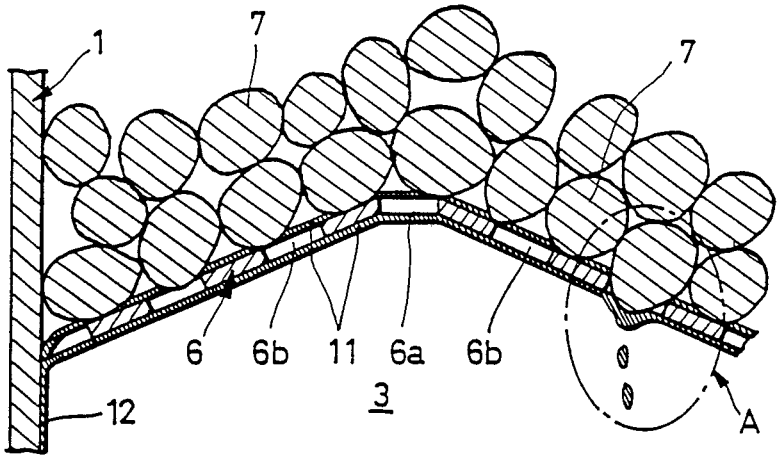
FIG. 3 is a typical section view illustrating the effect of the perforated plate used with the direct-contact type hot water heater according to the present invention.

In order to cause the perforated plate 6 to form the water film 11 flowing down along its both or all sides and to allow the apertures 6b to form the water film 11 by surface tension, it is required that the surface of the perforated plate 6 show good affinity with respect to water and be free from such an inert film as that formed on the surface of an oil or lustrous stainless steel so as to allow water to flow down along its both sides in the form of the thin water film 11. It is also required that the endothermic material 7 be restrained from projecting from the lower surface of the perforated plate 6 for the purpose of preventing destruction of the water film 11, as shown at A in Figure 3.

A water feed nozzle 8 is provided above the endothermic material 7 filled in the endothermic chamber 5 to scatter the water to be heated. A stack 9 is provided above the endothermic chamber 5 of the heater body 1 to discharge the high-temperature gas which has ascended from the high-temperature gas feed chamber 3 and heated the water in the endothermic chamber 5. A hot water discharge pipe 10 is provided to feed the hot water stored in the hot water reservoir 2 to the end place.

The direct-contact type hot water heater of the structure according to the present invention is used in the following manner.

A combustion gas resulting from fuel burned by means of the burner 4 such as an oil burner or a high-temperture gas such as a combustion gas obtainable from the engine, etc. is supplied to the high-temperature gas feed chamber 3, and the water to be heated is scattered on the endothermic material 7 placed on the perforated plate 6 in the endothermic chamber 5 through the water feed nozzle 8. Thereupon, the high-temperature gas in the feed chamber 3 passes through the endothermic chamber 5 and is discharged as a low-temperature gas from the stack 9. On the other hand, the scattered water flows down through the endothermic material 7 and along the slope of the perforated plate 6, during which it is heated by the high-temperature gas. The water is then further heated in the course of flowing down along both or all sides of the perforated plate 6 to the surroundings thereof in the form of the water film 11 and flowing down on the surrounding wall surface of the heater body 1 forming the high-temperature gas feed chamber 3 in the form of another water film 12. The water is finally stored in the reservoir 2, wherein it is additionally heated from above its surface to a desired temperature.

In the direct-contact type hot water heater according to the present invention as detailed above, the perforated plate 6 includes a slope allowing water to flow down along its both or all sides to the lower surroundings in the form of the water film 11 in the course of heating the water. The slope is provided therein with a number of apertures 6b capable of forming the water film 11 by surface tension, and the endothermic material 7 is located in a state where it does not project from the lower surface of the perforated plate 6. Thus, the water, which is scattered on the endothermic material 7 from above the endothermic chamber 5 and is coming down, flows down along both or all sides of the perforated plate 6 in the form of the water film 11 without causing any water droplet to fall down through the apertures 6b into the high-temperature gas feed chamber 3. Therefore, where the high-temperature gas feed chamber 3 includes the built-in burner 4 for the direct combustion of fuel, it is unlikely that the burner 4 may not work, or the combustion of fuel may get worse. Since the water flowing down through the endothermic material 7 flows down along both or all sides of the perforated plate 6 in the form of the water film 11 and along the surrounding entire wall surfaces of the high-temperature gas feed chamber 3 in the form of the water film 12, it is unlikely that the perforated plate 6 and the wall surfaces of the high-temperature gas feed chamber 3 may be overheated. The direct-contact type hot water heater according to the present invention provides an area of contact of the high-temperature gas with the water which is larger by the amount of areas of the water film 11 formed on both sides of the perforated plate 6 and the water film 12 formed along the surrounding entire wall surfaces of the chamber 3 as compared with the conventional direct-contact type. As a result, the efficiency of thermal transmission of the high-temperature gas is greatly improved.

Further, the direct-contact type hot water heater according to the present invention can be easily and inexpensively manufactured owing to the fact that the perforated plate 6 used is more simplified in structure than that used with the conventional direct-contact type hot water heater.

What is claimed is

1. A direct-contact type hot water heater comprising:
(a) a hot water reservoir;
(b) a high-temperature gas feed chamber located:
  (i) in an inside section of a heater body having an internal wall and
  (ii) above said hot water reservoir;
(c) an endothermic chamber located:
  (i) in an inside section of said heater body and
  (ii) above said high-temperature gas feed chamber;
(d) an endothermic material located in said endothermic chamber;
(e) means for spraying water over said endothermic material;
(f) means for generating a flame in said high-temperature gas feed chamber in order to burn gas therein; and
(g) a perforated plate located between said high-temperature gas feed chamber and said endothermic chamber and supporting said endothermic material, said perforated plate extending from side to side of said internal wall, being in peripheral contact with said internal wall over the full extent of its own periphery, and having a top apex, a plurality of apertures therethrough, and a slope which allows water to flow down from its top apex in the form of a water film, said plurality of apertures being sized and shaped so that, in use:

(i) the high temperature gas passes upwardly therethrough;

(ii) the water does not pass downwardly therethrough due to the surface tension of the water; and (iii) said endothermic material does not project downwardly into said apertures to break the surface tension.

2. A direct-contact type hot water heater as recited in claim 1 wherein said hot water reservoir is located:

(a) in an inside section of said heater body and (b) beneath said high-temperature gas feed chamber.

3. A direct-contact type hot water heater as recited in claim 1 wherein said perforated plate is of conical shape.

4. A direct-contact type hot water heater as recited in claim 2 wherein said slope has an angle of inclination of 10° or wider.

5. A direct-contact type hot water heater as recited in claim 1 wherein said perforated plate is of pyramidal shape.

6. A direct-contact type hot water heater as recited in claim 5 wherein said slope has an angle of inclination of 10° or wider.

* * * * *